US005882187A

United States Patent [19]

Gustafson et al.

[11] Patent Number: 5,882,187

[45] Date of Patent: Mar. 16, 1999

[54] PORTABLE FLARE TANK

[75] Inventors: Richard Brian Gustafson; Glen Darrell Worm, both of Calgary, Canada

[73] Assignee: Modern Industrial Rentals (1978) Ltd., Calgary, Canada

[21] Appl. No.: 948,671

[22] Filed: Oct. 10, 1997

Related U.S. Application Data

[63] Continuation of Ser. No. 556,430, Nov. 9, 1995, abandoned.

[51] Int. Cl.[6] ..... F23D 5/00

[52] U.S. Cl. ..... 431/202; 95/262

[58] Field of Search ..... 220/563, 565, 220/501; 431/202; 95/262

[56] References Cited

U.S. PATENT DOCUMENTS

| | | | |
|---|---|---|---|
| 2,243,176 | 5/1941 | Henst . | |
| 2,891,607 | 6/1959 | Webster et al. | 431/202 |
| 3,501,255 | 3/1970 | Greene | 431/202 |
| 3,633,687 | 1/1972 | West et al. . | |
| 3,852,019 | 12/1974 | Stranahan et al. | 431/202 |
| 4,009,985 | 3/1977 | Hirt | 431/202 |
| 4,397,659 | 8/1983 | Gowan et al. | 95/262 |
| 4,416,672 | 11/1983 | Underwood . | |
| 4,789,170 | 12/1988 | Reber | 220/563 |
| 5,380,195 | 1/1995 | Reid et al. . | |
| 5,429,496 | 7/1995 | Stephens et al. . | |
| 5,507,858 | 4/1996 | Jepson | 95/262 |

*Primary Examiner*—Carroll B. Dority
*Attorney, Agent, or Firm*—Burns, Doane, Swecker & Mathis, L.L.P.

[57] ABSTRACT

A flare tank 10 comprises a container 12 having a fluid inlet 14, a fluid outlet 16 and a fluid flow path between the inlet 14 and the outlet 16. A baffle plate 20 is provided in the container 12 between the inlet 14 and the outlet 16. The baffle plate 20 extends transversely relative to the flow path for forming at least a partial barrier to fluid flow in the flow path. A gas outlet, e.g., a chimney stack 18, is located on the container 12 for the discharge of gas separated from the fluid. A burner 46 is provided for the combustion of combustible gas passing through the outlet 18.

9 Claims, 3 Drawing Sheets

PORTABLE FLARE TANK

This application is a continuation of application Ser. No. 08/556,430, filed Nov. 9, 1995 and now abandoned.

FIELD OF THE INVENTION

This invention relates to a flare tank and, more particularly, to a flare tank used for separating oil from fluid, specifically to separate combustible games from mud which is produced during a drilling operation in the oil and gas industry.

BACKGROUND OF THE INVENTION

Flares are used in various applications for the disposal of waste gases through combustion. For example, when an oil well is tested, combustible gases may be burned off through the use of a flare tank or stack.

In previous operations, mud from the drill rig which contained combustible gases was piped to or disposed of in a flare pit adjacent to the drill rig. The flare pit is simply a hole dug in the ground which is used to hold the mud. However, the combustible gases can separate from the mud in the flare pit and accidentally ignite thereby causing emissions to the atmosphere which are environmentally unattractive and dangerous to closely located personnel both by way of danger to the person but also due to the possibility of starting a grass or brush fire. Likewise, the mud in the flare pit and the combustible gas can create ground contamination which is also of concern for environmental reasons. Finally, it is necessary to often haul away the mud within the flare pit due to the contamination by unburned gases. This is costly.

It is an object of the present invention to provide a flare tank which facilities separation of the combustible gases from the fluid being treated for gas disposal. It is a further object of the invention to provide a flare tank which is portable so as to minimize disturbances on work sites.

SUMMARY OF THE INVENTION

According to the invention there is provided a flare tank comprising a container having a fluid inlet, a fluid outlet and a fluid flow path between said inlet and said outlet; a baffle plate in the container between said fluid inlet and said fluid outlet, said baffle plate projecting into said flow path of said fluid for forming at least a partial barrier to fluid flow in said path and a gas outlet on said container for the discharge of gas separated from said fluid in said container.

A burner is conveniently used to ignite the separated gas in order to burn it off following its separation from the fluid in the flare tank.

The baffle place may extend substantially transversely across the flow path, the baffle plate being provided with a recess at a lower end thereof for the flow of fluid therethrough.

The baffle plate may be provided with at least one opening above the recess for the passage of gas therethrough. Preferably, a plurality of openings is provided above the recess in the baffle plate.

The gas outlet in the container may comprise a chimney stack on the container. The chimney stack may be pivotally connected to the container for collapsing the chimney stack onto the container to facilitate transportation of the flare tank. The burner may be located at the top end of the chimney stack.

The container may be mounted on a pair of skids to facilitate movement of the flare tank into a desired location.

Further objects and advantages of the invention will become apparent from the description of a preferred embodiment of the invention below.

DETAILED DESCRIPTION OF PREFERRED EMBODIMENT

Figure 1:
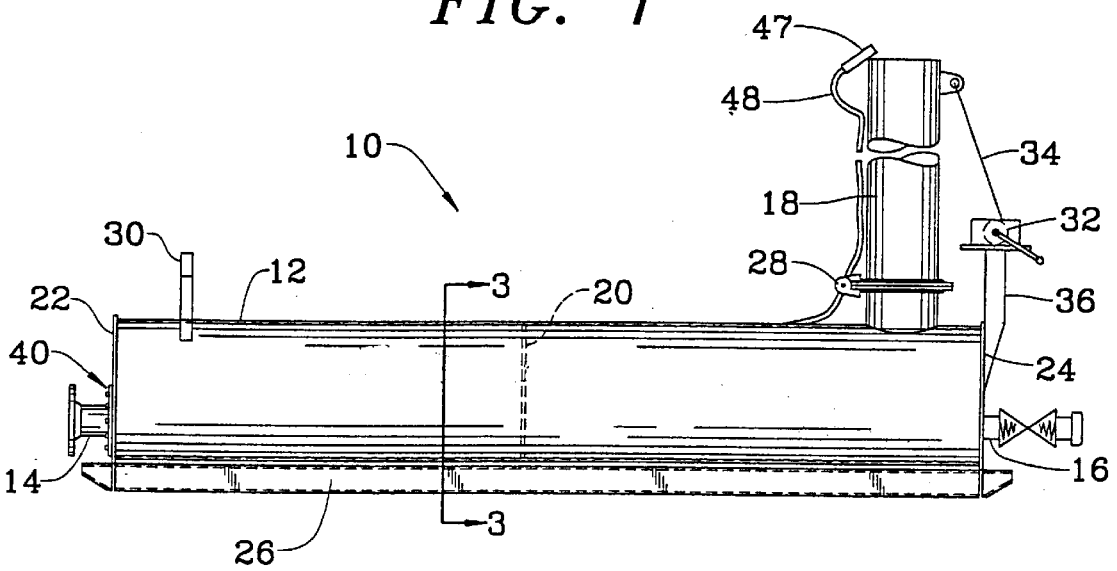
FIG. 1 is a side view of a portable flare tank according to the invention.
Figure 2:
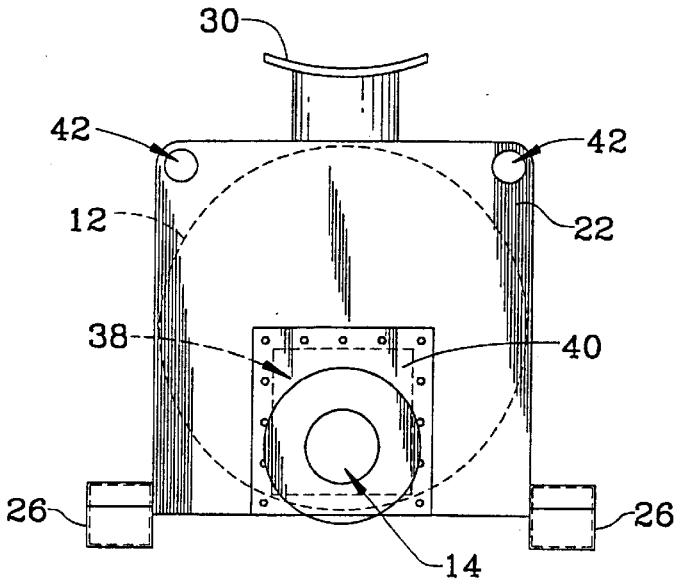
FIG. 2 is an end view of the flare tank of FIG. 1.

In the drawings reference numeral 10 generally indicates a flare tank comprising a cylindrical container 12 having an inlet 14 and an outlet 16, a chimney stack 18, located at the outlet end of the container 12, and a baffle plate 20 in the container 12.

The container 12 is conveniently in the form of a 20 inch diameter pipe and approximately 10 feet long. The container 12 is provided with end plates 22 and 24 at its inlet and outlet ends, respectively. A pair of skids 26 is attached between the plates 22 and 24 for supporting the flare tank 10 and to facilitate moving it into position along the ground.

The chimney stack 18 is connected through a pivotal connection 28 to the container 12 so that it can be collapsed into a generally horizontal position on the container 12 for transport purposes. The housing 12 is provided with a saddle 30 at its opposite end for supporting the free end of the chimney stack IS when in the collapsed position. A winch 32 with a cable 34 is provided for raising and lowering the chimney stack 18. The winch 32 is attached to the end plate 24 by means of a pillar 36, which may be in the form of a length of square tubing.

The end plate 22 is provided with a cutout 38 which is covered by a removable cover plate 40 for inspection purposes. The plates 22, 24 are also provided with holes 42 for lifting purposes. The outlet 16 is provided with a threaded end for receiving a gate valve.

Figure 3:
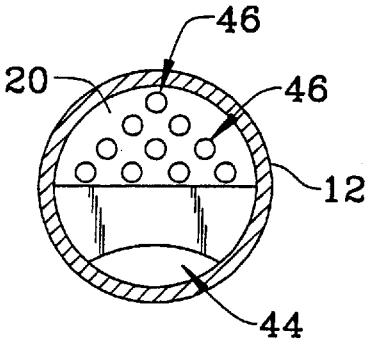
FIG. 3 is a cross section taken along the lines III—III in FIG. 1.

The baffle plate 20 is provided with a recess 44 at its lower end to allow for the passage of fluid therethrough. The baffle plate 20 is further provided with a plurality of holes 46, of about 1¼ inch diameter, and spaced as shown in FIG. 3.

A gas burner 47, which is connectable through a hose 48 to a supply of combustible gas, such as gas in a pressurized cylinder (not shown), is provided. For convenience, a cage (now shown) for holding the gas cylinder can be attached to one side of the container 12.

OPERATION

In use, the flare tank 10 is transported to a desired site, e.g. where an oil well is being drilled. The mud or fluid from the well being drilled contains oil and gas. In order to burn off the gas, the fluid is flowed into the container 12 through the inlet 14, e.g., along a conduit, referred to as the "flare line", extending from the drill string into which the mud from the well is initially introduced.

As the fluid is flowed into the container 12, it impacts upon the baffle plate 20 which causes agitation of the fluid, resulting in separation of the gas, such as H2S, from the fluid. The gas escapes through the openings 46 and passes through the chimney stack 18 where the combustible gas is ignited and burned by the burner 47. The burner 47 is ignited prior to the gases passing through the chimney stack 18.

The flare tank 10 can be used in various different applications, e.g., where it is not desirable to dig a flare pit, such as for environmental considerations, or where it is not possible to dig a flare pit, such as with off shore drilling operations.

Figure 5:
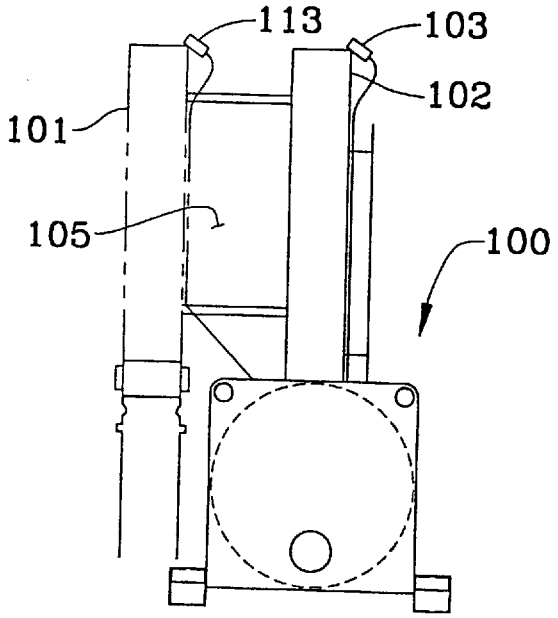
FIG. 5 is an end view of the apparatus illustrated in FIG. 4.
Figure 4:
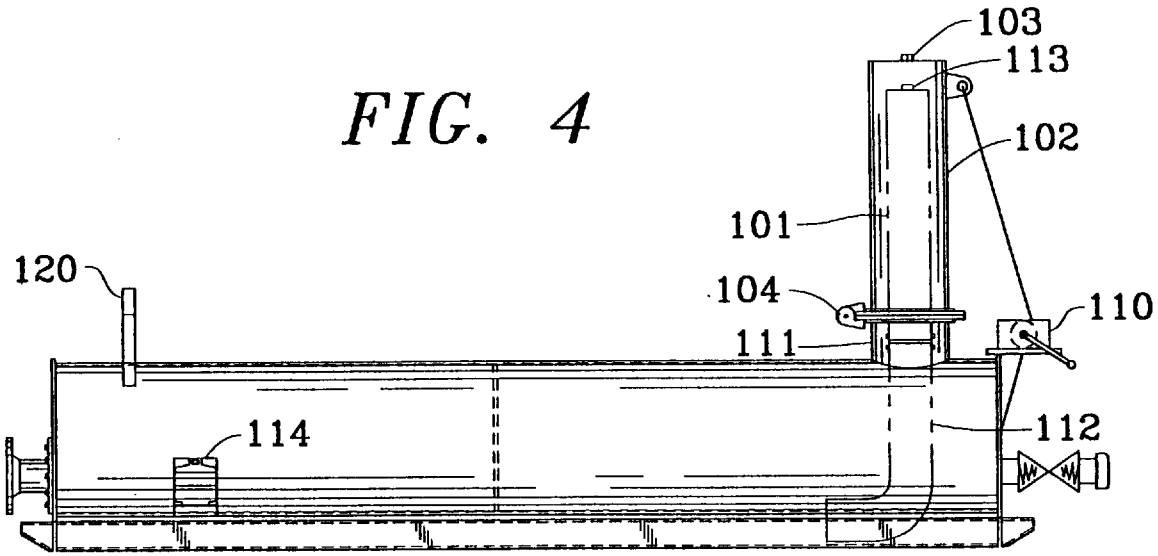
FIG. 4 is a side view similar to that of FIG. 1 but illustrating a second chimney stack.

A further embodiment of the invention is illustrated in FIGS. 4 and 5. In this embodiment, the flare tank generally illustrated at 100 has a second chimney stack 101 connected thereto and additional to first chimney stack 102, Chimney stack 102 operates similarly to the chimney stack 18 of the FIG. 1 embodiment; that is, it has a pivoted connection (not shown) and an igniter 103 all as illustrated and described in accordance with the FIG. 1 embodiment.

The second chimney stack 101, however, is additional. It has a pivoted connection 104 and may be raised from the horizontal to the vertical position illustrated using winch 110. The chimney stack 101 has a quick coupler 111 which allows the stack 101 to be connected directly to a pipe 112 which connects with the degaser line (not illustrated) extending from the mud tanks of the drill rig (not illustrated). Second chimney stack 101 has its own igniter 113 and each of the igniters 103, 113 is connected to its own respective fuel source, conveniently a propane tank 114. A saddle 120 is provided for holding both of the chimney stacks 101, 102 in their horizontal or transport positions and a mounting bracket 105 is positioned between the two chimney stacks 101, 102 to securely hold the chimney stacks 101, 102 in position.

The operation of the flare tank 100 is similar to that described in connection with the embodiment of FIG. 1. The second chimney stack 101, however, is connected directly to the degaser line (not shown) extending from the mud tanks of the drill rig (not shown). Thus, no fluid enters second chimney stack 101 and no baffle plate is required, the gas being emitted from the chimney stack 101 as the igniter 113 ignites the gases travelling from the outlet of the chimney stack 101.

Many modifications will readily occur to those skilled in the art to which the invention relates and the specific embodiments described should be taken as illustrative of the invention only and not as limiting its scope as defined in accordance with the accompanying claims.

What is claimed is:

1. A flare tank for separating combustible gas from fluid produced during a drilling operation, comprising:

a container for separating fluid from combustible gas, the container possessing a longitudinal axis, the container having an interior, a fluid inlet for introducing fluid containing combustible gas into the interior of the container, a fluid outlet for discharging from the container fluid from which the combustible gas has been at least partially removed, and a flow path extending between the fluid inlet and the fluid outlet;

a baffle plate disposed in the interior of the container between the fluid inlet and the fluid outlet, the baffle plate being spaced from the fluid inlet, being positioned generally perpendicular to the longitudinal axis of the container and projecting into said flow path to form at least a partial barrier to fluid flowing from the fluid inlet to the fluid outlet along the flow path so that the fluid impacts upon the baffle plate to facilitate separation of combustible gas from the fluid, said baffle plate including a plurality of through holes;

gas discharge means provided on the container in communication with the interior of the container for discharging from the interior of the container the combustible gas that has been separated from the fluid; and a burner positioned adjacent an outlet of the gas discharge means for igniting the combustible gas discharged through the gas discharge means.

2. A flare tank according to claim 1, wherein said container is an elongated horizontally oriented container.

3. A flare tank according to claim 1, wherein said baffle plate is provided with a recess for permitting the flow of fluid past the baffle plate and towards the fluid outlet.

4. A flare tank according to claim 3, wherein said recess is located in a lower portion of said baffle plate.

5. A flare tank for separating combustible gas from fluid produced during a drilling operation, comprising:

a container for separating fluid from combustible gas, the container possessing a longitudinal axis, the container having an interior, a fluid inlet for introducing fluid containing combustible gas into the interior of the container, a fluid outlet for discharging from the container fluid from which the combustible gas has been at least partially removed, and a flow path extending between the fluid inlet and the fluid outlet;

a baffle plate disposed in the interior of the container between the fluid inlet and the fluid outlet, the baffle plate being spaced from the fluid inlet and the fluid outlet and being positioned generally perpendicular to the longitudinal axis of the container and projecting into said flow path to form at least a partial barrier to fluid flowing from the fluid inlet to the fluid outlet along the flow path so that the fluid impacts upon the baffle plate to facilitate separation of combustible gas from the fluid;

a chimney stack mounted on the container in communication with the interior of the container for discharging from the interior of the container the combustible gas that has been separated from the fluid, said chimney stack being pivotally connected to said container for collapsing the chimney stack into a horizontal position onto said container to facilitate transportation of the flare tank; and a burner positioned adjacent an outlet of the chimney stack for igniting the combustible gas discharged through the outlet of the chimney stack.

6. The flare tank according to claim 5, wherein said chimney stack has a top end positioned remote from the container, said burner being located at the top end of the chimney stack.

7. The flare tank according to claim 1, wherein said container is mounted on skids to facilitate movement of the flare tank to a desired location.

8. The flare tank according to claim 1, wherein said chimney stack is a first chimney stack, and further comprising a second chimney stack for the combustion of gas from a well and a second burner to ignite gas passing through said second chimney stack.

9. A method of separating combustible gas from fluid obtained during a drilling operation and subsequently discharging the combustible gas, comprising:

introducing fluid from a drilling operation that contains combustible gas into a fluid inlet located at a lower portion of a container having an interior, the container also having a fluid outlet and a longitudinal extent;

flowing the fluid through the interior of the container along a flow path;

separating combustible gas from the fluid by impacting the fluid against a baffle plate which extends substantially perpendicular to the flow path and includes a plurality of through holes and that is disposed within the interior of the container between the fluid inlet and the fluid outlet so that the baffle plate projects into the flow path for forming at least a partial barrier to fluid flowing from the fluid inlet to the fluid outlet along the flow path, the entire baffle plate being spaced from the fluid inlet so that fluid enters the interior of the container and flows along a portion of the interior of the container before impacting the baffle plate, the combustible gas separated from the fluid passing through the through holes in the baffle plate;

discharging, through the fluid outlet, fluid from which combustible gas has been separated;

discharging, from the interior of the cylinder through a gas outlet, the combustible gas that has been separated from the fluid; and igniting the combustible gas discharged through the gas outlet.

* * * * *